United States Patent [19]

Jullien

[11] Patent Number: 4,513,275

[45] Date of Patent: Apr. 23, 1985

[54] PUSH-BUTTON CONTROLLED MINIATURIZED THERMAL CUTOUT/SWITCH

[75] Inventor: Gérard M. R. Jullien, Paris, France

[73] Assignee: L'Equipement et la Construction Electrique en abrege E.C.E., France

[21] Appl. No.: 490,349

[22] Filed: May 2, 1983

[30] Foreign Application Priority Data

Mar. 9, 1983 [EP] European Pat. Off. ..... 83400481.4

[51] Int. Cl.[3] ..... H01H 71/16

[52] U.S. Cl. ..... 337/66; 335/164; 337/68

[58] Field of Search ..... 337/66, 64, 68; 335/164, 165

[56] References Cited

U.S. PATENT DOCUMENTS 3,007,018 10/1961 Wood ..... 337/66

3,538,476 11/1970 Auchapt et al. ..... 337/66

3,792,403 2/1974 Bullock ..... 337/66

*Primary Examiner*—Harold Broome

*Attorney, Agent, or Firm*—McGlew and Tuttle

[57] ABSTRACT

A miniaturized plug-in cutout/switch is controlled by a push-button (1) and comprises a connection and disconnection mechanism using a captive ball (4*d*) circulating in a track cage (4*a*), having two positions selected by successive applications of pressure to the push-button (1) corresponding to the switch connected and switch disconnected states. The cutout/switch includes an independent locking mechanism for a movable contacts (11) which is operated by a bimetallic strip (8) which triggers the opening of the contacts when a current overload occurs in the protected circuit. The simple design of the apparatus permits a miniaturized construction which is particularly advantageous for its use on panels where small dimensions and the rationalization of its shapes make it suitable, for example on aircraft panels.

5 Claims, 10 Drawing Figures

PUSH-BUTTON CONTROLLED MINIATURIZED THERMAL CUTOUT/SWITCH

BACKGROUND OF THE INVENTION

The present invention relates to a low-tension, single-pole, double-break electric cutout/switch whose function is to protect circuits against current overloads exceeding a predetermined value, and which is equipped with a thermal compensation device.

Its miniaturized construction and its presentation in the form of a small rectangle of molded material on the top of which is disposed a push-button incorporated in the profile of its square section make it particularly suitable for use on control panels where small dimensions and ergonomy are desired.

In one embodiment it is designed to be connected by plugging into a connector, and it is thus possible to form a group of n elements in "square base mosaic" form so as to constitute particularly handsome panels (interface in plane form). The disconnection of a unit will entail the projection of its button relative to the interface plane and will therefore be immediately detectable.

One particular form of installation of these cutouts, known as "basket" installation, permits the removal of units from the front (button side), thus providing a dual advantage: fixed wiring of the receptacle connectors fastened to the structure, and facilitated maintenance because it is possible to remove an element from a live system, that is a system to which power is maintained.

Another advantageous technical feature of the invention consists of the independence of the connection/disconnection mechanism in relation to the overload protection mechanism, which cannot be mechanically impeded.

PRIOR ART

Up to the present time low-tension cutouts have been made with a push-pull type of control, that is to say a button enables contacts to be closed when pressed and to be opened when pulled. In another version two independent buttons served respectively for connection and disconnection.

These two designs have disadvantages. The first makes it necessary to design a button which projects in relation to the body of the apparatus. The second makes it necessary to have a larger front face, since the distance between the control buttons must be sufficient to prevent misoperation through the pressing of both buttons at the same time. These disadvantages are accentuated in the case of miniaturized equipment intended for panels of small dimensions. Another disadvantage of known designs consists in that it is possible to override the protective mechanism through successive applications of pressure for operation as a switch.

SUMMARY OF THE INVENTION

The present invention eliminates these disadvantages through its design, in which only a single push-button is provided, which when successively depressed will alternately effect connection and disconnection.

Moreover, the independence of the connection and disconnection mechanism (switch functions) in relation to the current overload protection mechanism makes it impossible to override this mechanism by maintaining pressure on the push-button.

The description given below with reference to the accompanying drawings, which illustrate non-limiting examples, will help to understand fully how the present invention can be put into practice.

DESCRIPTION OF THE PREFERRED EMBODIMENTS

Figure 1A:
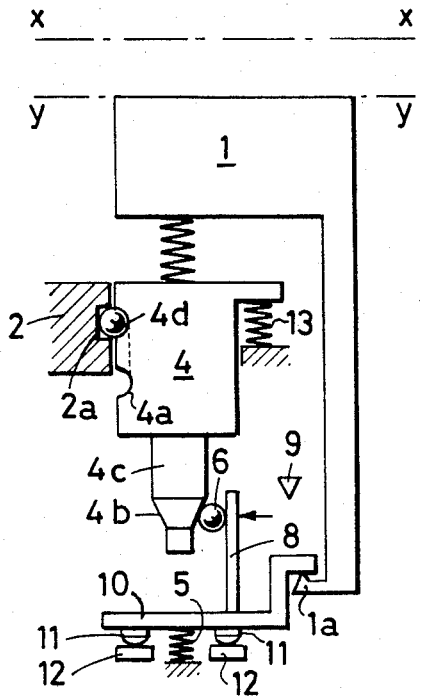
FIG. 1*a* is a diagrammatical side elevational view, partially in section, of the inventive push button switch with its push button having been depressed and being held in switch closing position.

FIG. 1*a* is a basic diagram showing the principal components of the invention, wherein: 1 designates the push-button which is provided with a blade the end of which forms a stop 1*a*; 2 designates a fixed projecting part which is fastened to the casing of the switch and in which a groove 2*a* has been formed to enable a ball 4*d* to make a lateral movement; and 4 constitutes a drive shaft of a support 10 for movable contacts 11. The fixed contacts are designated 12. The axes X and Y delimit respectively the level of the surface of the push-button when the cutout is disconnected or connected.

Figure 2:
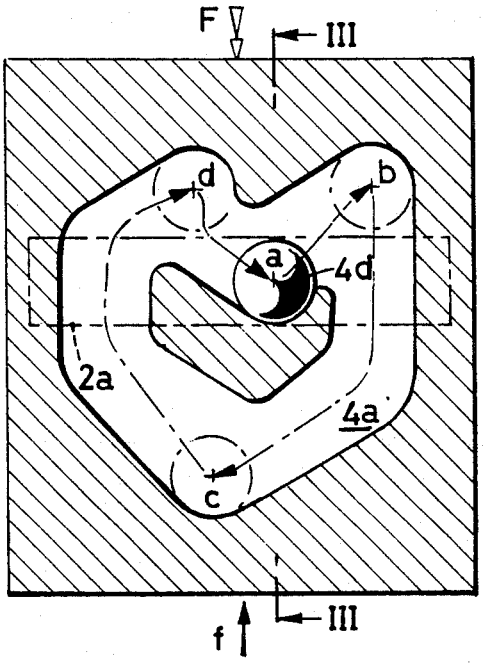
FIG. 2 is a sectional view through a drive shaft of the switch, showing a track cage for confining the movement of a ball.
Figure 3:
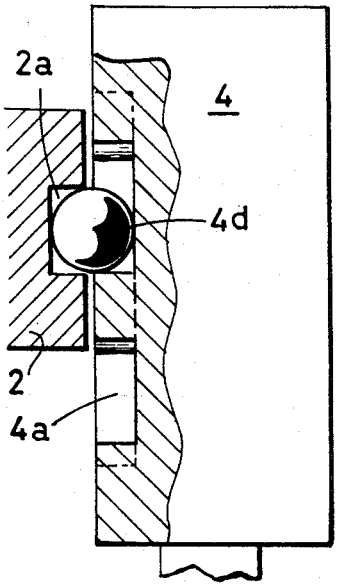
FIG. 3 is a view taken along lines III—III of FIG. 2.

The mechanism for the manual closing and opening of the contacts is shown in FIG. 2, and a section on the line III—III of that Figure is shown in FIG. 3, in which can be seen the ball 4*d* captive between a profile 4*a* (track cage) of the shaft 4 and a groove 2*a* in the molded body of the apparatus.

Starting from the position shown in FIGS. 2, and 3 with the ball in a first ball seat a, pressure applied to the push-button 1 will be transmitted to the shaft 4 in the direction F, thus bringing about a translatory movement of the shaft 4 through the compression of the spring 5. The ball 4*d*, following the profile or first inclined surface of the track cage 4*a*, will assume the position b or second ball seat. When the pressure on the push-button 1 is relaxed, the ball 4*d* will move to c a third seat, thus enabling the shaft 4 to rise through the action of the force f of the spring 5. A second application of pressure to the button will bring the ball to over a second inclined surface to a forth seat d, and after the suppression of the force F the ball will again return to a.

Figure 1B:
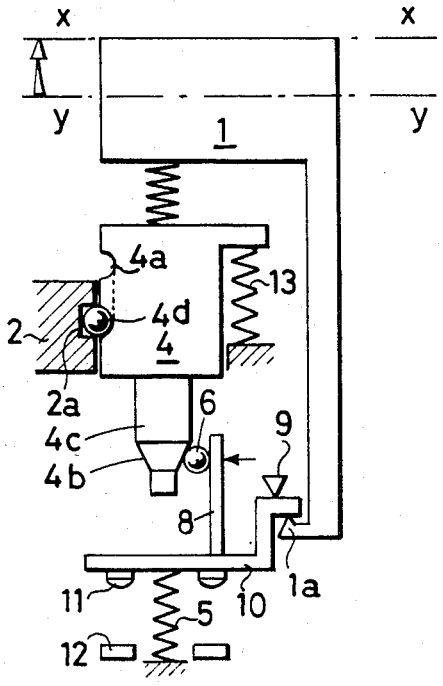
FIG. 1*b* is a view similar to FIG. 1*a* showing the push button after it has again been depressed and thus returned to its open position.

This has the consequence that two successive applications of pressure to the button will select two positions of the contacts, namely:

contacts closed (FIG. 1*a*)

contacts open (FIG. 1*b*)

which correspond to the switch function.

Figure 1C:
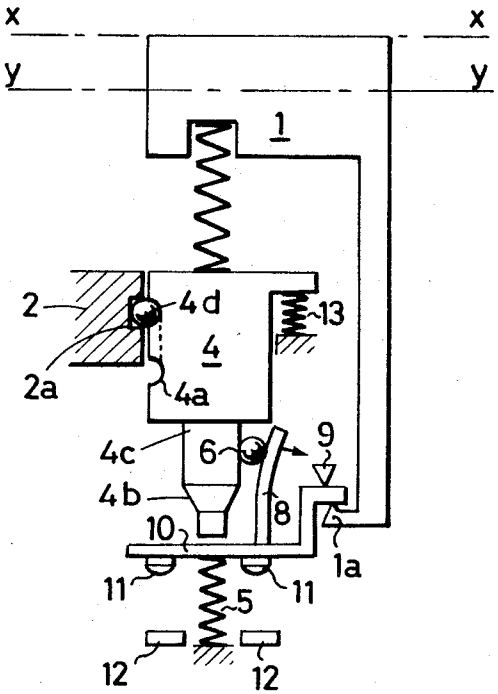
FIG. 1*c* is a view similar to FIG. 1*a* showing an open position of the switch which has resulted from the movement of a thermally responsive element in the switch, due to an overload condition.
Figure 1D:
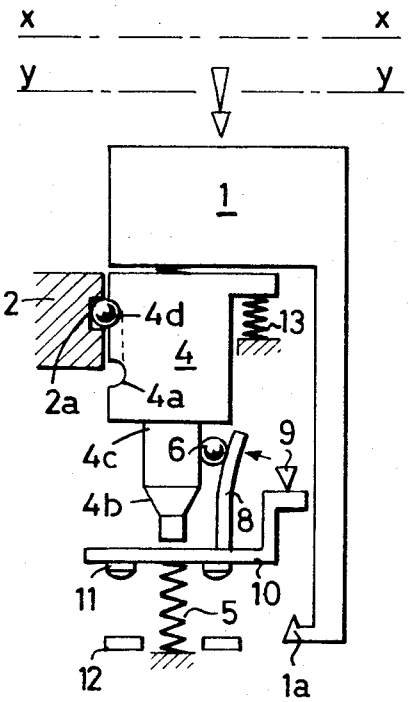
FIG. 1*d* is a view similar to FIG. 1*a* showing the position of the switch if the push button is pressed after an overload condition has taken place, with the switch remaining open.

The device for disconnection as the result of a fault or overload will be described with reference to FIG. 1*a*, in which the apparatus is shown in the connected or closed state. When a current passing through the bimetallic strip 8 exceeds a predetermined value, the bimetallic strip is deformed through heating and enables the ball 6, through the pressure of the spring 5, to be freed from the stress applied by the conical portion **4*b* of the contact drive shaft 4, and to slide along the cylindrical portion 4*c* of this shaft. Through the action of the spring 5 the support arrangement for the movable contacts 10 will rise, its movement being halted by a stop 9** (FIG. 1*c*). This ball device constitutes an overload locking mechanism or means, protecting against current overload. FIG. 1*d* shows how again pressing button 1 will not close the switch.

Figure 1E:
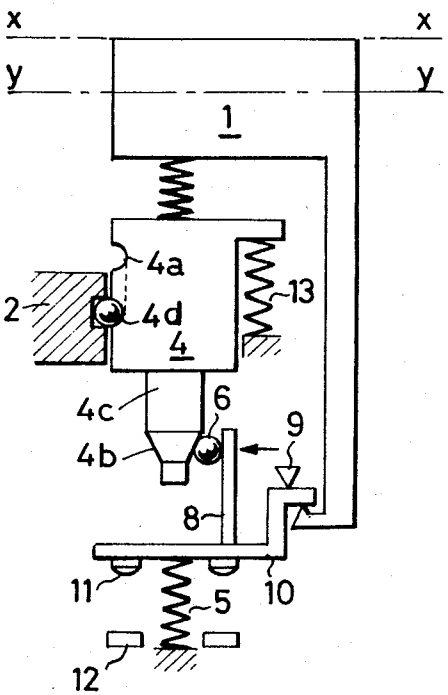
FIG. 1*e* is a view similar to FIG. 1*b*, showing how the switch returns to its normal load condition, while remaining open.
Figure 6:
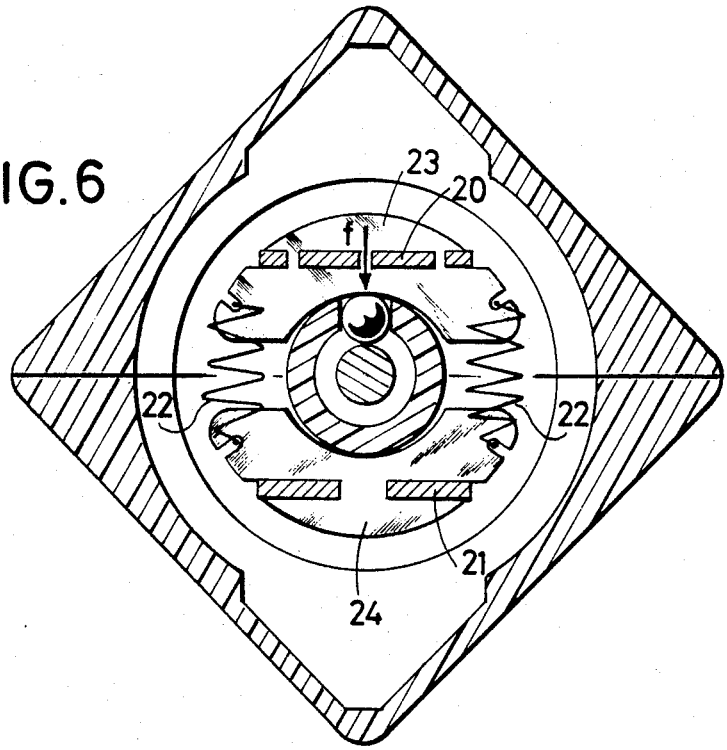
FIG. 6 is a transverse sectional view taken along the lines VI—VI of FIG. 4.

The apparatus will be rearmed in two stages. A first application of pressure to the push-button will bring the mechanism (after this pressure has been relaxed) to the position corresponding to manual disconnection of the apparatus (FIG. 1*e* or 1*b*). Because of the force of the cooled bimetallic strip the ball 6 will in fact resume its position in which it bears against the conical portion **4*b* of the shaft 4**. A second application of pressure (FIG. 1*a*) will reconnect the apparatus in accordance with the manual connection process. An ambient temperature compensation device is provided in the form of a second, antagonistic bimetallic strip in the locking mechanism; its construction is illustrated in FIG. 6, which is a section through the drive shaft 4 for the movable contacts. Two half-rings 23 and 24 are mutually guided and held around the axis of the said shaft by tension springs 22. In these half-rings are received the ends of a current overload bimetallic strip 20 and a compensator bimetallic strip 21 respectively, the forces of these strips prevailing against the force of the springs. The half-ring 23 presses the ball 6 against the cylindrical portion of the shaft 4 at the level of the conical shoulder, with a force f in FIG. 6.

This has the consequence that the force F holding the movable contacts in engagement (in accordance with the principle of the automatic disconnection described above) is a component of three forces, including the antagonistic force of the temperature compensation bimetallic strip 21, which consequently will act on the disconnection point.

Figure 4:
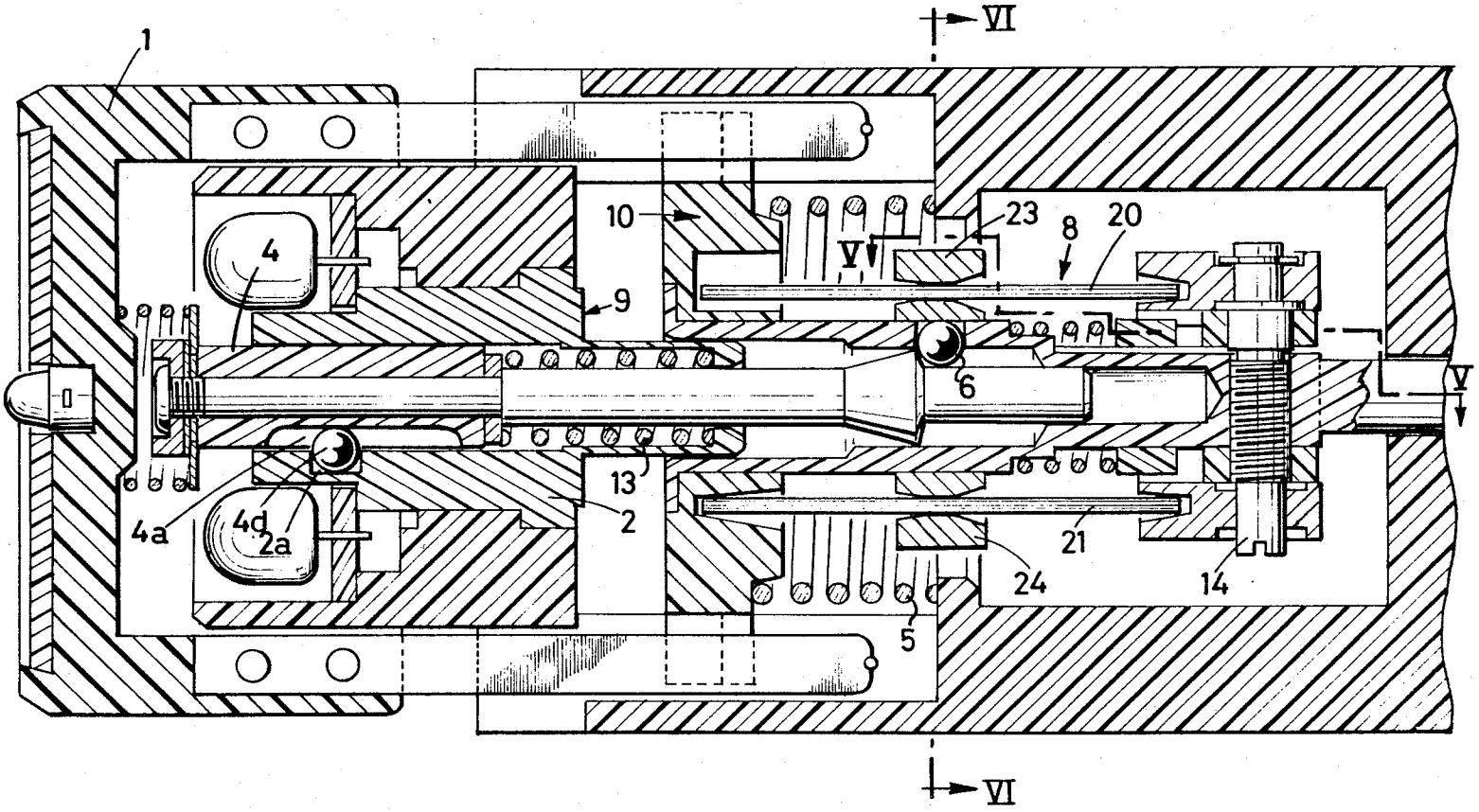
FIG. 4 is a longitudinal sectional view of an actual embodiment of the inventive switch.

In practise an adjustment is provided (by means of a screw 14) for the purpose of regulating the support forces of the bimetallic strips (FIG. 4).

Figure 5:
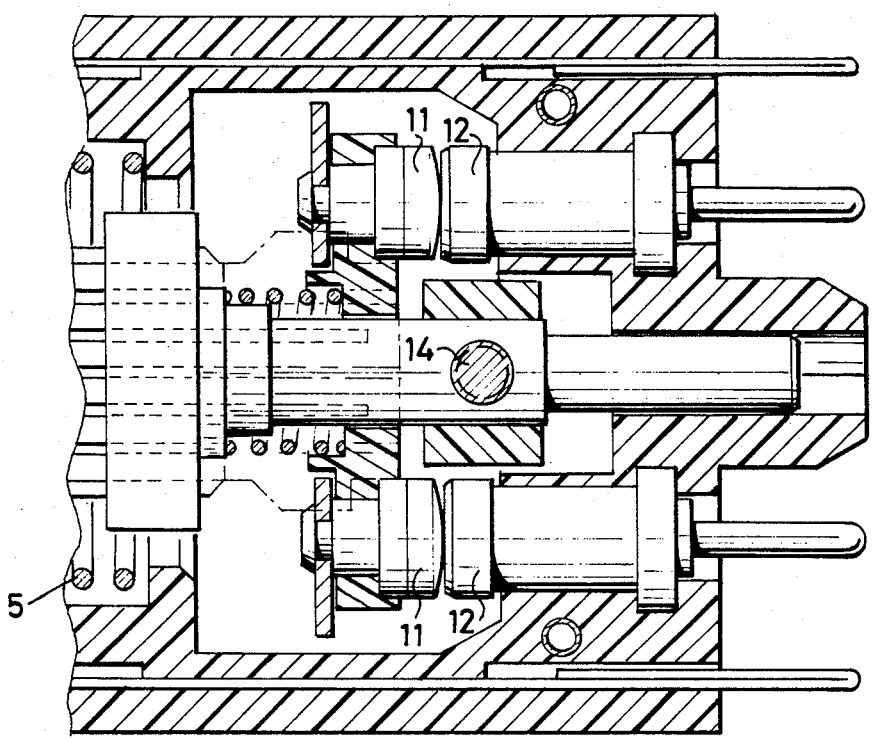
FIG. 5 is a longitudinal sectional view of the lower end of the switch shown in FIG. 4, in part taken along the lines V—V of FIG. 4.

FIGS. 4 and 5 are views in section of an embodiment of the apparatus according to the invention, in which the principal operating elements are shown, particularly the push-button 1, the fixed and movable contacts 11 and 12, the spring 5 of the mechanism for locking the movable contacts, and the shaft 4 controlling the device for locking the movable contacts. This device, which includes the track cage **4*a*, the ball 4*d* and the groove 2*a*** will be termed switch actuation locking means having a first position for closing the switch when the button is pressed in a downward direction, and a second position for opening the switch when the button is again pressed in the same direction.

What is claimed is:

1. A miniaturized low-tension double contact switch with thermal overload protection, comprising:

a housing having two fixed contacts (12);

a push-button (1) movably mounted to said housing for movement in a first direction and for movement in a second opposite direction;

a movable contact support (10) movably mounted to said housing;

two movable contacts (11) connected to said support and aligned with said two fixed contacts for closing said two fixed contacts when said support is moved to engage said two movable contacts against said two fixed contacts;

actuation locking means (**2,2*a*,4,4*a*,4*d***) engageable by said push button for movement into a first position with movement of said push button in its first direction, for effecting movement of said support to close said two fixed contacts, and movable into a second position when said push button is again moved in its first direction for moving said support to open said fixed contacts;

overload locking means (**4*b*,6,8**) engaged between said actuation locking means and said movable contact support having a normal load position for transmitting movement of said actuation locking means to said support to move said support to close said fixed contacts with movement of said actuation locking means, and an overload position for disengaging movement of said support from movement of said actuation locking means; and biasing means engaged between said housing and said movable contact support for moving said movable contact support into a position opening said fixed contact when said overload locking means is in its overload position.

2. A switch according to claim 1, wherein said overload locking means comprises a tensioning element (22) for biasing said overload locking means against said actuation locking means, and adjustment means engaged with said tensioning elements for adjusting a biasing force between said overload locking means and said actuation locking means to adjust an amount of force necessary, with said overload locking means in its normal load position, to transmit movement of said actuation locking means to said movable contact support.

3. A switch according to claim 2, wherein said actuation locking means comprises a groove formed in said housing, a drive shaft movably mounted in said housing and having a track cage facing said groove, a ball engaged in said groove and in said track cage, said push button engageable with said shaft for moving said shaft in a direction toward said fixed contacts with movement of said push button in its first direction, said track cage defining a path of movement for said ball and having a first ball seat (a) against which said ball is engaged for holding said shaft in a position for applying said support against said fixed contacts, an inclined surface facing said first ball seat for moving said ball transversely of said first direction with movement of said push button in said first direction, a second ball seat (b) spaced laterally of said first ball seat and at an end of said first inclined surface with respect to said first direction, said track cage having a path portion for permitting movement of said ball from said second ball seat to a third ball seat with movement of said drive shaft in said second direction under the influence of said biasing means, said track cage having a second inclined surface terminating at a fourth ball seat, said second inclined surface positioned to cause movement of said ball from said third ball seat to said fourth ball seat with movement of said shaft in said first direction, said ball being held in said groove throughout movement of said ball around said path.

4. A switch according to claim 3, wherein said overload locking means comprises a bi-metal strip connected to said support, a second ball engaged between said bi-metal strip and said shaft and said drive shaft having a conical portion for engagement on said ball with said overload locking means in its normal position for transmitting movement of said drive shaft to said contact support, said bi-metal strip being heatable to move away from said conical portion to disengage said second ball from said conical portion and permit relative movement between said drive shaft and said contact support.

5. A switch according to claim 4, wherein said adjustment means comprises a set screw for changing a tension of said bi-metal strip by which said bi-metal strip pushes said second ball against said conical portion of said drive shaft.

* * * * *